United States Patent [19]

Wafer

[11] 4,031,492

[45] June 21, 1977

[54] TRIPLE BREAK CURRENT LIMITER

[75] Inventor: John A. Wafer, Monroeville, Pa.

[73] Assignee: Westinghouse Electric Corporation, Pittsburgh, Pa.

[22] Filed: Aug. 22, 1975

[21] Appl. No.: 607,005

[52] U.S. Cl. ..... 335/16; 335/147; 335/196

[51] Int. Cl.[2] ..... H01H 77/10

[58] Field of Search ..... 335/16, 195, 147, 196; 317/75

[56] References Cited

UNITED STATES PATENTS 3,813,619 5/1974 Koval ..... 335/195

FOREIGN PATENTS OR APPLICATIONS 189,685 12/1955 Austria ..... 317/75

*Primary Examiner*—Harold Broome
*Attorney, Agent, or Firm*—R. E. Converse, Jr.

[57] ABSTRACT

A current limiter providing for a rapid triple series break in the protected circuit. Two movable contact arms are electromagnetically driven apart by two electromagnetic or slot motor drives for rapid circuit interruption when current through the current limiter exceeds a predetermined value. This provides twice the rate of contact separation than that which can be obtained from a single contact arm and consequently increases the rate of arc voltage rise and reduces peak let through current. The magnetic drive devices are formed from a ferromagnetic material and have a narrow slot formed therein, which is magnetically open on one end. Each contact arm is disposed in the slot of an associated magnetic drive device near the open end thereof. Each movable contact arm has a pair of spaced apart contacts mounted thereon. One of these contacts engages a stationary contact and the other contact engages a mating contact on the opposing movable contact arm when the current limiter is closed. Each movable contact arm is biased to the closed position by a magnetic latch. Under high overload conditions the force tending to separate the movable contact arms is large and the magnetic latch mechanisms release and the slot motors rapidly open the circuit interrupter. U-shaped plates are provided in the vicinity of contact separation to facilitate arc extinction.

8 Claims, 3 Drawing Figures

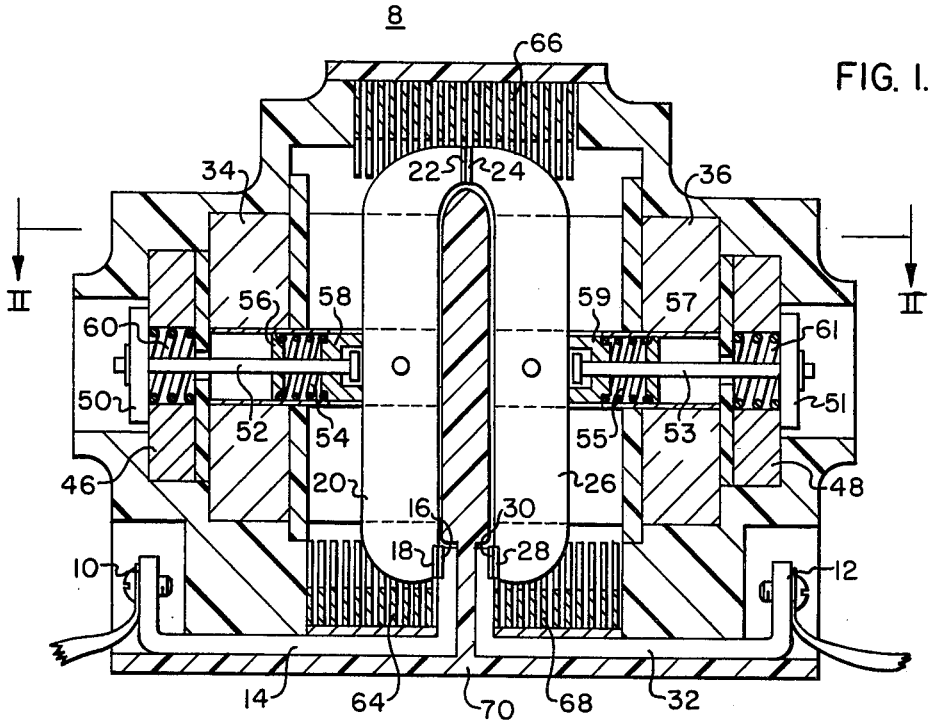
FIG. 1.
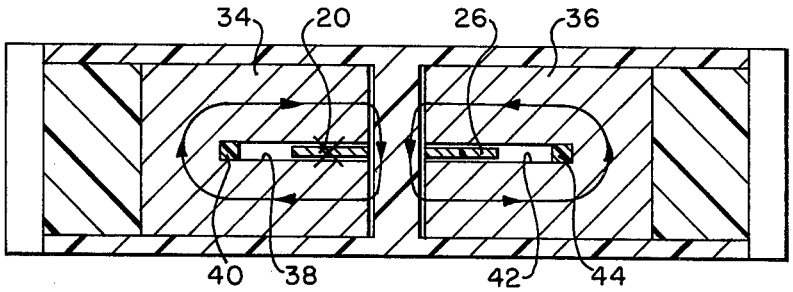
FIG. 2.
FIG. 3.
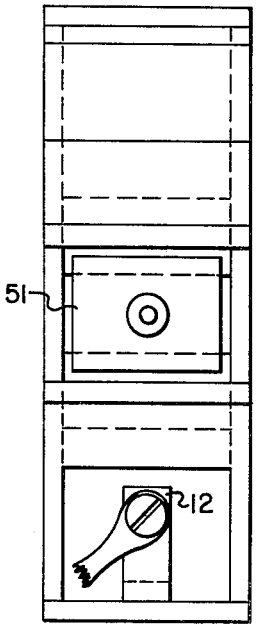

TRIPLE BREAK CURRENT LIMITER

CROSS-REFERENCE TO RELATED APPLICATIONS

The invention disclosed in the instant application is related to the following: (1) U.S. Patent application Ser. No. 577,518, filed May 14, 1975, by John A. Wafer (W.E. Case 45,044); and (2) U.S. Pat. application Ser. No. 503,232, filed Sept. 5, 1974, by John A. Wafer, which is a continuation of U.S. Patent application 437,586, filed Jan. 29, 1974.

BACKGROUND OF THE INVENTION

1. Field of the Invention:

This invention relates to circuit interrupters and more particularly to a current limiting circuit interrupter providing for triple break interruption.

2. Description of the Prior Art:

It is known in the prior art to provide a circuit interrupter having an elongated current carrying contact arm in which an overload current generates electromagnetic forces to cause a magnetic drive device or slot motor to drive the contact arm to an open position at high speed to provide current limiting action. An example of such a circuit interrupter is disclosed in U.S. Pat. No. 3,815,059 to L. A. Spoelman which discloses a circuit interrupter in series with an electromagnetic current limiting device which utilizes forces generated by the overload current to drive the movable contact arm open. In U.S. Pat. No. 3,815,059 the current limiting device is provided with a movable contact arm which pivots around one end and which moves into the slot of a magnetic drive device during circuit interruption. One advantage of a magnetic drive circuit interrupter in conjunction with a circuit breaker, such as a common toggle-type breaker, is that the current limiting device can be reset and reused after each operation without requiring replacement of fuses.

In the circuit interrupter art it has long been recognized that it is a distinct advantage to provide fast interruption of an established arc. As well known by those skilled in the art, it is desirable to effect a rapid extinction of the arc as quickly as possible inasmuch as the current flow through electrical equipment will damage the equipment unless the fault current is limited. Likewise, the ability to rapidly reset and reuse the current limiting device is desirable, that is resettable circuit interrupters have many well-recognized advantages over fused devices.

SUMMARY OF THE INVENTION

In accordance with the teachings of the present invention a triple break dual contact arm current limiter is provided. The two movable contact arms are driven apart by two electromagnetic drives or linear slot motors when a predetermined current level is exceeded. Alternately, a single slot motor yoke having both contact arms disposed in the slot can be utilized. The two linear slot motor drives provide twice the rate of total effective contact separation as a single drive. This rapid separation increases the rate of rise of arc voltage and thereby reduces the peak let-through current.

Each movable contact arm has two spaced apart contacts mounted thereon and is supported for generally rectilinear movement. Each contact arm is disposed in the magnetically open slot of a magnetic drive yoke. The movable contact arm is positioned near the open end of the magnetic drive yoke. The magnetic drive yoke can be formed of a plurality of laminated U-shaped sheets stacked to provide a slot, one end of which is magnetically open. The slot motor which consists of the magnetic drive yoke and the movable contact arm operates to draw the movable contact arm rapidly into the slot when the current through the contact arm exceeds a predetermined value. During heavy fault current conditions the self-induced magnetic fields generated cause strong magnetic forces tending to rapidly separate the contact arms and thereby effect a very rapid arc lengthening action. This arc lengthening causes a rapid rise of the arc voltage across the arc plasma thereby bringing about desirable fault current limitation.

Magnetic latches are provided to hold the movable contact arms in the closed position. A spring, to provide the desired spring biasing force, is disposed between the magnetic latch and the associated contact arm. Upon the occurrence of high fault currents movable contact arms are forced apart unlatching the magnetic latch and moving the current limiter to the open position.

Each movable contact arm has a pair of spaced apart contacts disposed thereon. One of the pair of contacts engages a stationary contact and the other one engages a mating contact on the other movable contact arm. Thus when the predetermined fault current level is exceeded the contact arms are separated causing a triple break of the circuit through the current limiter. The gap formed between the mating contacts on the movable contact arms is approximately twice as great as the gap formed between the stationary contact and the mating contact mounted on the associated contact arm.

It is an object of this invention to teach a current limiter providing for a triple contact break during circuit interruption.

It is a further object of this invention to disclose a current limiter utilizing two movable bridging contact arms and two magnetic drive devices for rapidly opening the interrupter and providing current limiting action.

BRIEF DESCRIPTION OF THE DRAWINGS

For a better understanding of the invention, reference may be had to the preferred embodiment exemplary of the invention shown in the accompanying drawings in which:

FIG. 1 is a side sectional view through a current limiter utilizing the teaching of the present invention;

FIG. 2 is a top sectional view taken along the lines II—II of FIG. 1; and,

FIG. 3 is an end view of the current limiter shown in FIG. 1.

DESCRIPTION OF THE PREFERRED EMBODIMENT

Referring now to the drawings there is shown a current limiter 8 utilizing the teachings of the present invention. Terminals 10 and 12 are provided for connecting the current limiter 8 in series in the circuit to be protected. With current limiter 8 in the closed position as shown in FIG. 1 a continuous current path exists from terminal 10 through L-shaped conductor 14, through contact pair 16–18, through movable contact arm 20, through contact pair 22–24, through movable contact arm 26, through contact pair 28–30, through L-shaped conductor 32 to terminal 12. Contact arms 20 and 26 are movable and during current limiting operations rapidly move to an open position wherein contact pairs 16–18, 22–24, and 28–30 are open. Movable contact arms 20 and 26 are supported for rectilinear movement. Magnetic yokes 34 and 36 are provided for rapidly moving contact arms 20 and 26 to an open position when a predetermined current is exceeded. If desired, a single continuous yoke can be used in place of yokes 34 and 36. Narrow slots 38 and 40 are provided in the magnetic drive yokes 34 and 36 respectively. The magnetic drives or yokes 34 and 36 are of a generally rectangular shaped formed of a plurality of laminations of relatively thin plates of soft magnetizable material, such as iron or cold rolled steel, that are secured together in a surface-to-surface relationship. The laminations are secured together to define slots 38 and 40 the ends of which are open. Pads 42 and 44 of a resilient material such as nylon are disposed in the closed end of slots 38 and 40 to serve as a bumper for the contact arms 20 and 26 when they move from the closed to the open position during current limiting operations.

Permanent magnets 46 and 48 are utilized for holding the movable contacts 20 and 26 in the closed position. Permanent magnet 46 holds plate 50 in place. Plate 50 is attached to a shaft 52 which is movable by contact arm 20 when contact arm 20 is moved to the open position during current limiting. A spring 54 is disposed between plate 56, rigidly connected to shaft 52, and a slide member 58, connected to contact arm 20. This provides a spring biasing closing force when permanent magnet 46 latches plate 50. During an opening operation movable contact arm 20 moves contacting shaft 52 which causes plate 50 to be separated from permanent magnet 46. Contact arm 20 continues to move until it engages nylon stop 40. The contact arm is then held in the open position by spring 60. Operation of movable contact arm 26 is generally the same as that for contact arm 20. Permanent magnet 48 holds plate 51 in a fixed position until plate 51 is unseated by shaft 53 being moved under the influence of movable contact arm 26. Movable contact arm 26, when plate 51 is latched, is held in the closed position by spring 55 acting between slide 59 and fixed plate 57. When plate 51 is latched, movable contact arm 26 is held in the open position by spring 61. When circuit interrupter 8 opens, the bridging contact arms 20 and 26 move rapidly apart. The speed of separation of contact pair 22–24 is twice as fast as the separation of contact pairs 16–18 and 28–30. This is due to the fact that both bridging contact arms 20 and 26 are moving apart during a current limiting operation. A plurality of U-shaped metallic plates 64, 66 and 68 are provided in the vicinity of contact pair 16–18, 22–24, and 28–30 respectively. These facilitate rapid arc extinction of any arc formed between the contact pairs during current limiting. This current limiting device is disposed in an insulating housing 70, a portion of which extends between movable contact arms 20 and 26.

Thus it can be seen that current limiter 8 can be switched from a closed position, wherein contact pairs 16–18, 22–24 and 28–30 are in engagement, to an open position, wherein contact pairs 16–18, 22–24 and 28–30 are open, when a predetermined current is exceeded. Current flow in bridging contact arms 20 and 26 is in the opposite direction and the magnetic forces generated by the current flow tend to force them apart. Magnetic yokes 34 and 36 disposed around the portion of contact arms 20 and 26 respectively concentrate the magnetic flux generated by current flow through the current limiter 8 to a rapidly open the bridging contact arms 20 and 26 when a predetermined current level is exceeded. Upon the occurrence of a high fault current the magnetic forces will cause exertion of a very large force separating bridging contact arms 20 and 26 which through shaft 52 and 53 unlatch holding plates 50 and 51. The fast separation of contact arms 20 and 26 causes a rapid increase in the arc voltage of the three serially related arcs formed in the current limiter 8. This provides for effective current limiting.

Current limiter 8 has the advantage that the current passed through the center of bridging contact arms 20 and 26 is such that it will rapidly drive the arc off of contacts 22–24 and into the U-shaped plate 66. The direction of the current through the contact arms 20 and 26 is such that they will repel each other. The three break system has some advantage over the dual break system in that contact arms 20 and 26 only have to travel half the distance that is necessary in a dual break single bridging contact arm design for the same operating voltage. The operating voltage of the disclosed device can be increased by providing for greater contact arm travel. A quadruple break construction can easily be provided by providing a fixed contact between contact pairs 22 and 24. A flux transfer device or electrically operated latch can be provided for unlatching contact arms 20 and 26.

What we claim is:

1. A current limiting circuit interrupter comprising:
a first stationary contact;
a second stationary contact;
a first elongated bridging member having a first movable contact and a second movable contact disposed in a spaced apart relationship thereon;
a second elongated bridging member having a third movable contact and a fourth movable contact disposed in a spaced apart relationship thereon; and,
operating means associated with said first elongated bridging member and said second elongated bridging member for moving said first elongated bridging member and said second elongated bridging member in opposite directions from a closed position wherein said first movable contact engages said first stationary contact, said second movable contact engages said third movable contact and said fourth movable contact engages said second stationary contact to an open position wherein said first movable contact is spaced apart from said first stationary contact, said second movable contact is spaced apart from said third movable contact and said fourth movable contact is spaced apart from said second stationary contact.

2. A current limiting circuit interrupter as claimed in claim 1 wherein with the circuit interrupter in the open position, the separation of said second movable contact and said third movable contact is greater than the separation between said first movable contact and said first stationary contact.

3. A current limiting circuit interrupter as claimed in claim 2 wherein the separation of said second movable contact and said third movable contact is approximately twice as great as the separation between said first movable contact and said first stationary contact.

4. A current limiting circuit interrupter as claimed in claim 1 wherein operating means comprises:

a first yoke formed of a magnetizable material having a slot formed therein within which said first elongated bridging member is disposed; and, a second yoke formed of a magnetizable material having a slot formed therein within which said second elongated bridging member is disposed.

5. A current limiting circuit interrupter as claimed in claim 4 comprising:

a first magnetic latch comprising a first permanent magnet and a first armature plate, said first armature plate being connected to said first elongated bridging member, said first magnetic latch having a latched position wherein said first permanent magnet and said first armature plate are relatively close together and an unlatched position wherein said first permanent magnet and said first armature plate are relatively spaced apart;

first spring biasing means disposed between said first magnetic latch and said first elongated bridging member for holding said bridging member in the closed position when said first magnetic latch is in the latched position;

a second magnetic latch comprising a second permanent magnet and a second armature plate, said second armature plate being connected to said second elongated bridging member, said second magnetic latch having a latched position wherein said second permanent magnet and said second armature plate are relatively close together and an unlatched position wherein said second permanent magnet and said second armature plate are relatively spaced apart; and, second spring biasing means disposed between said second magnetic latch and said second elongated bridging member for holding said second elongated bridging member in the closed position when said second magnetic latch is in the latched position.

6. A current limiting circuit breaker comprising:

a housing;

an electrically conducting current path formed through said housing;

a first pair of contacts disposed in said current path;

a second pair of contacts disposed in series with said first pair of contacts in said current path;

a third pair of contacts disposed in series with said first pair of contacts and said second pair of contacts in said current path; and, operating means for opening said first pair of contacts, said second pair of contacts, and said third pair of contacts when current flow through the current limiter exceeds a predetermined value; said operating means comprising first electromagnetic drive means controlling opening of said first pair of contacts and said second pair of contacts, and, second electromagnetic drive means controlling opening of said second pair of contacts and said third pair of contacts;

the separation of said second pair of contacts when in the open position being greater than the separation between said first pair of contacts when in the open position.

7. A current limiting circuit breaker as claimed in claim 6 comprising:

a first bridging contact arm having one of said first pair of contacts attached thereto and one of said second pair of contacts attached thereto; and, a second bridging contact arm having one of said second pair of contacts attached thereto and one of said third pair of contacts attached thereto.

8. A current limiter as claimed in claim 7 comprising:

a first magnetic latch for latching said first bridging contact arm in a closed position; and a second magnetic latch for latching said second bridging contact arm in a closed position;

each of said magnetic latches comprising a permanent magnet and an armature plate, said armature plate being connected to the associated bridging contact arm.

* * * * *